US009348243B2

(12) United States Patent
Okada

(10) Patent No.: US 9,348,243 B2
(45) Date of Patent: May 24, 2016

(54) ELECTROPHOTOGRAPHIC PHOTOSENSITIVE MEMBER

(71) Applicant: KYOCERA Document Solutions Inc., Osaka (JP)

(72) Inventor: Hideki Okada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/521,612

(22) Filed: Oct. 23, 2014

(65) Prior Publication Data

US 2015/0118606 A1 Apr. 30, 2015

(30) Foreign Application Priority Data

Oct. 29, 2013 (JP) ..... 2013-224287

(51) Int. Cl.
*G03G 15/04* (2006.01)
*G03G 5/06* (2006.01)

(52) U.S. Cl.
CPC ..... *G03G 5/065* (2013.01); *G03G 5/0651* (2013.01); *G03G 5/0655* (2013.01)

(58) Field of Classification Search
CPC .... G03G 5/065; G03G 5/0651; G03G 5/0655
USPC ..... 430/58.5, 78; 399/338
See application file for complete search history.

(56) References Cited

U.S. PATENT DOCUMENTS 7,291,429 B2 11/2007 Kim et al.
2005/0112482 A1 5/2005 Kim et al.

FOREIGN PATENT DOCUMENTS

JP 2005-154444 A 6/2005

*Primary Examiner* — Thorl Chea
(74) *Attorney, Agent, or Firm* — Studebaker & Brackett PC

(57) ABSTRACT

An electrophotographic photosensitive member includes a photosensitive layer containing a naphthalenediimide derivative represented by the following general formula (1). In the general formula (1), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms. $R_2$ and $R_3$, independently from each other, each represent an alkyl group having 1 to 4 carbon atoms, a halogen group, or a cyano group.

(1)

6 Claims, 1 Drawing Sheet

ELECTROPHOTOGRAPHIC PHOTOSENSITIVE MEMBER

INCORPORATION BY REFERENCE

The present application claims priority under 35 U.S.C. §119 to Japanese Patent Application No. 2013-224287, filed Oct. 29, 2013. The contents of this application are incorporated herein by reference in their entirety.

BACKGROUND

The present disclosure relates to electrophotographic photosensitive members.

As an electrophotographic photosensitive member included in an image forming apparatus, there has been known an organic photosensitive member containing: a binder resin; a charge generating material; and a hole transport material and an electron transport material as charge transport materials; and so on. Such an organic photosensitive member is advantageous in that it can be produced more easily and have higher degree of freedom in structural design as having more options for materials of the photosensitive member as compared with an inorganic photosensitive member including an inorganic material such as amorphous silicon.

In order for an image forming apparatus including an organic photosensitive member as an electrophotographic photosensitive member to form high-quality images, there is a strong need for the organic photosensitive member to have sufficient photosensitivity. In particular, where the photosensitive member is to be positively charged in use, the photosensitivity of the electron transport material has great impact on the quality of an image to be formed by the image forming apparatus. Accordingly, various electron transport materials capable of enhancing the photosensitivity of the organic photosensitive member have been investigated.

SUMMARY

An electrophotographic photosensitive member of the present disclosure includes a photosensitive layer containing a naphthalenediimide derivative represented by the general formula (1).

(1)

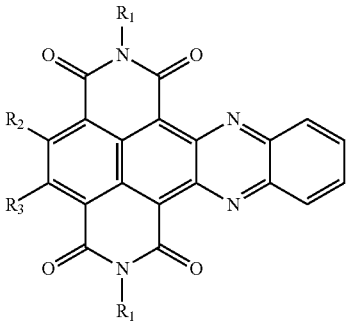

In the general formula (1), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms. $R_2$ and $R_3$, independently from each other, each represent an alkyl group having 1 to 4 carbon atoms, a halogen group, or a cyano group.

DETAILED DESCRIPTION

Figure 1A:
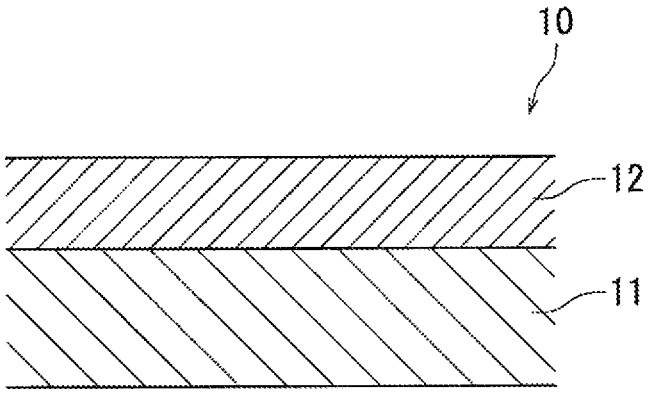
FIG. 1A is a schematic cross sectional view showing a structure of an electrophotographic photosensitive member according to an embodiment of the present disclosure.

Hereinafter, an electrophotographic photosensitive member according to an embodiment of the present disclosure will be described in detail; however, the present disclosure is not limited thereto.

[Naphthalenediimide Derivative]

The electrophotographic photosensitive member according to the present embodiment has a photosensitive layer containing a specified naphthalenediimide derivative. In the naphthalenediimide derivative, one benzene ring of the naphthalene structure has a functional group different from that of the other benzene ring. The naphthalenediimide derivative has an asymmetric structure with respect to an axis perpendicular to a direction of the sequence of the benzene rings of the naphthalene structure.

Specifically, the naphthalenediimide derivative has a quinoxaline structure made up of one benzene ring of the naphthalene structure and a pyrazine ring sharing one side with the benzene ring. Specifically, the naphthalenediimide derivative is represented by the general formula (1).

(1)

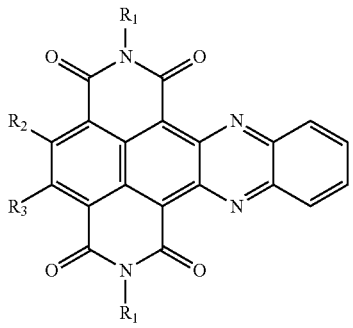

In the general formula (1), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms. $R_2$ and $R_3$, independently from each other, each represent an alkyl group having 1 to 4 carbon atoms, a halogen group, or a cyano group.

The naphthalenediimide derivative represented by the general formula (1) (hereinafter, may be referred to as "naphthalenediimide derivative (1)") has high electron mobility. Accordingly, an electrophotographic photosensitive member containing the naphthalenediimide derivative (1) shows excellent photosensitivity. The photosensitivity will be described in detail in examples.

Examples of the alkyl group having 1 to 10 carbon atoms represented by $R_1$ include methyl group, ethyl group, isopropyl group, t-butyl group, pentyl group, hexyl group, heptyl group, octyl group, nonyl group, and decyl group. Of the alkyl groups having 1 to 10 carbon atoms, an alkyl group having more carbon atoms is preferably used. This is because when an electrophotographic photosensitive member contains a naphthalenediimide derivative having such an alkyl group as $R_1$, the possibility of crystallization on a surface of the photosensitive member during formation of the photosensitive layer can be reduced. In this view, the alkyl group having 1 to 10 carbon atoms represented by $R_1$ is preferably an alkyl group having 3 to 10 carbon atoms, more preferably an alkyl group having 5 to 10 carbon atoms, particularly preferably an alkyl group having 7 to 10 carbon atoms, and most preferably an octyl group.

Examples of the aryl group having 6 to 12 carbon atoms represented by $R_1$ include phenyl group, naphthyl group, and biphenyl group. In particular, phenyl group is preferable. The aryl group is optionally substituted with an alkyl group having 1 to 10 carbon atoms. Examples of the alkyl group having 1 to 10 carbon atoms as the substituent include the groups mentioned as examples of the alkyl group having 1 to 10 carbon atoms represented by $R_1$. The alkyl group having 1 to 10 carbon atoms as the substituent is preferably an alkyl group having 1 to 5 carbon atoms, more preferably an alkyl group having 1 to 3 carbon atoms, and particularly preferably a methyl group. Examples of the aryl group having 6 to 12 carbon atoms and optionally having an alkyl group having 1 to 10 carbon atoms include tolyl group (specifically, o-, m-, or p-tolyl group), cumenyl group (specifically, o-, m-, or p-cumenyl group), xylyl group (specifically, 2,3-xylyl group, 2,4-xylyl group, 2,5-xylyl group, 2,6-xylyl group, 3,4-xylyl group, or 3,5-xylyl group), and mesityl group. In particular, xylyl group is preferable, and 2,6-xylyl group is more preferable. In the aryl group having 6 to 12 carbon atoms and optionally having an alkyl group having 1 to 10 carbon atoms, the number and the substitution position of alkyl groups as substituents are not particularly limited.

Examples of the aralkyl group having 7 to 12 carbon atoms represented by $R_1$ include benzil group and phenethyl group.

Examples of the cycloalkyl group having 3 to 10 carbon atoms represented by $R_1$ include cyclopropyl group, cyclobutyl group, cyclopentyl group, cyclohexyl group, cycloheptyl group, cyclooctyl group, cyclononyl group, and cyclodecyl group.

Examples of the alkoxy group having 1 to 6 carbon atoms represented by $R_1$ include methoxy group, ethoxy group, propoxy group, butoxy group, pentoxy group, and hexoxy group.

Of the above-mentioned groups, $R_1$ is preferably an alkyl group having 1 to 10 carbon atoms from a standpoint of the photosensitivity and from a standpoint of the compatibility with the later-described binder resin. More preferably, $R_1$ is an octyl group. In another embodiment, from the same standpoints, $R_1$ is preferably an aryl group having 6 to 12 carbon atoms and optionally having an alkyl group having 1 to 10 carbon atoms, and more preferably a xylyl group.

Examples of the alkyl group having 1 to 4 carbon atoms represented by $R_2$ and $R_3$ include methyl group, ethyl group, isopropyl group, and t-butyl group.

Examples of the halogen group represented by $R_2$ and $R_3$ include fluoro group, chloro group, bromo group, and iodo group. In particular, bromo group is preferable.

In the general formula (1), $R_2$ is preferably a halogen group or a cyano group. Likewise, $R_3$ is preferably a halogen group or a cyano group. More preferably, $R_2$ and $R_3$ are the same functional group in the general formula (1).

The naphthalenediimide derivative (1) is synthesized in accordance with the following scheme (r), for example.

(r)

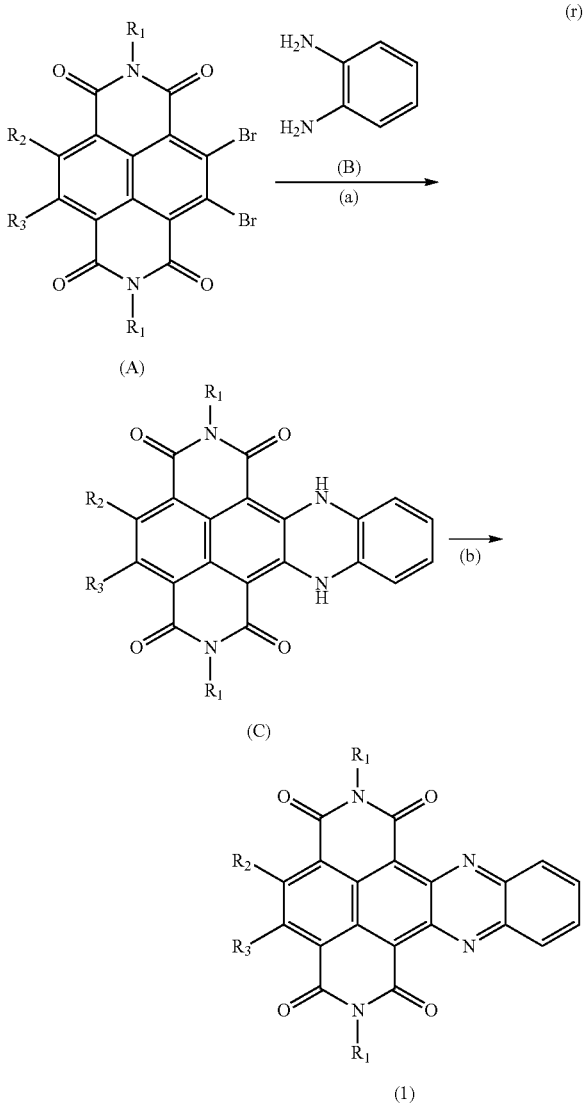

In the scheme (r), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms. $R_2$ and $R_3$, independently from each other, each represent an alkyl group having 1 to 4 carbon atoms, a halogen group, or a cyano group.

[Electrophotographic Photosensitive Member]

The electrophotographic photosensitive member of the present embodiment includes a photosensitive layer containing the naphthalenediimide derivative (1). The electrophotographic photosensitive member of the present embodiment has excellent photosensitivity. Accordingly, an image forming apparatus including such an electrophotographic photosensitive member can form high-quality images. The electrophotographic photosensitive member of the present embodiment is favorably used as a positively chargeable photosensitive member.

The electrophotographic photosensitive member of the present embodiment may be a single-layer photosensitive member or a multi-layer photosensitive member. A charge generating material, a hole transport material, an electron transport material, and a binder resin are contained in a single layer (photosensitive layer) in the single-layer photosensitive member. A charge generating layer and a charge transport layer are stacked on a conductive substrate in the multi-layer photosensitive member. The charge generating layer contains a charge generating material and a base resin (binder resin for charge generating layer). The charge transport layer contains an electron transport material, a hole transport material, and a binder resin. In the multi-layer photosensitive member, the electron transport material may act as an electron acceptor compound for increasing the efficiency of charge generation in the charge generating layer.

Since at least two layers need to be formed for producing the multi-layer photosensitive member, the production process thereof may be complicated. On the other hand, the single-layer photosensitive member has a simpler photosensitive layer structure than the multi-layer photosensitive member and therefore the production process thereof is simpler.

In the multi-layer photosensitive member, the charge generating layer and the charge transport layer are each thinner than the photosensitive layer of the single-layer photosensitive member. Accordingly, the charge generating layer and the charge transport layer are vulnerable to damage. In particular, the charge generating layer is extremely thin, and therefore the performance of the electrophotographic photosensitive member may be lowered. On the other hand, the photosensitive layer of the single-layer photosensitive member can be easily made thicker than the charge generating layer or the charge transport layer of the multi-layer photosensitive member. Accordingly, the photosensitive layer is less likely to be damaged completely. Thus, when the electrophotographic photosensitive member of the present embodiment is a single-layer photosensitive member, the possibility of the occurrence of a film defect in the photosensitive member can be reduced.

Figure 1B:
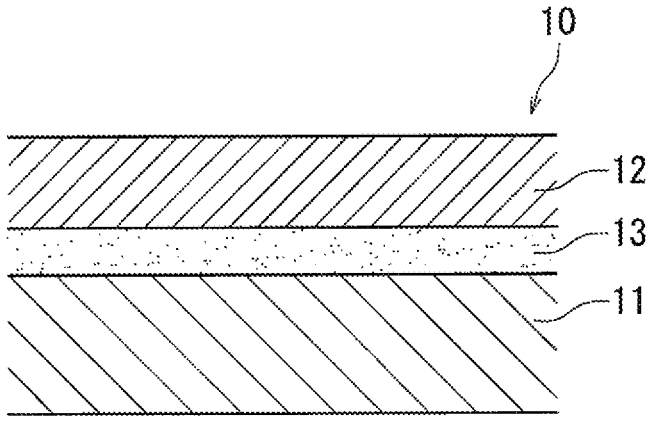
FIG. 1B is a schematic cross sectional view showing another structure of the electrophotographic photosensitive member according to the embodiment of the present disclosure.

Hereinafter, an example of the electrophotographic photosensitive member of the present embodiment will be described with reference to FIGS. 1A and 1B. An electrophotographic photosensitive member 10 includes a conductive substrate 11 and a photosensitive layer 12. The photosensitive layer 12 is provided on the conductive substrate 11. Preferably, the photosensitive layer 12 contains the naphthalenediimide derivative (1) as an electron transport material, an charge generating material, a hole transport material, and a binder resin. For example, the photosensitive layer 12 may be provided directly on the conductive substrate 11 as shown in FIG. 1A. In addition, the photosensitive layer 12 may be exposed as an outermost layer as shown in FIG. 1A. Alternatively, the electrophotographic photosensitive member 10 may be provided with an intermediate layer 13 between the conductive substrate 11 and the photosensitive layer 12 as shown in FIG. 1B as long as the properties of the electrophotographic photosensitive member 10 are not impaired.

[Conductive Substrate]

Various conductive materials may be used for the conductive substrate 11. Examples of the materials usable for the conductive substrate 11 include metals (e.g., iron, aluminum, copper, tin, platinum, silver, vanadium, molybdenum, chromium, cadmium, titanium, nickel, palladium, indium, stainless steel and/or brass); plastic materials prepared by depositing or laminating the above-mentioned metal thereto; and glass coated with aluminum iodide, tin oxide, and/or indium oxide.

The conductive substrate 11 may take the form of a sheet or a drum depending on the structure of the image forming apparatus in which the conductive substrate 11 is used. The entire conductive substrate 11 may have conductivity or only a surface of the conductive substrate 11 may have conductivity. Preferably, the conductive substrate 11 has sufficient mechanical strength.

[Photosensitive Layer]

The photosensitive layer 12 may contain the naphthalenediimide derivative (1), a charge generating material, a hole transport material, and a binder resin. The naphthalenediimide derivative (1) contained in the photosensitive layer 12 acts as an electron transport material, which is one of charge transport materials.

(1)

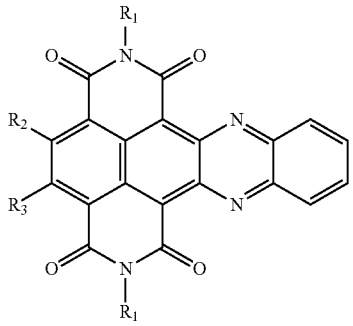

In the general formula (1), $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms. $R_2$ and $R_3$, independently from each other, each represent an alkyl group having 1 to 4 carbon atoms, a halogen group, or a cyano group.

[Electron Transport Material]

Preferably, the naphthalenediimide derivative (1) is used as an electron transport material in the electrophotographic photosensitive member 10. For example, naphthalenediimide derivatives represented by the formulae (1-1) to (1-4) are favorably used. Hereinafter, the naphthalenediimide derivatives represented by the formulae (1-1) to (1-4) may be referred to as "naphthalenediimide derivatives (1-1) to (1-4)".

(1-1)

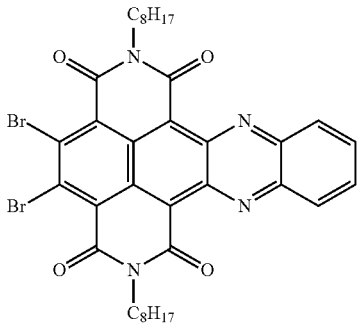

-continued (1-2)

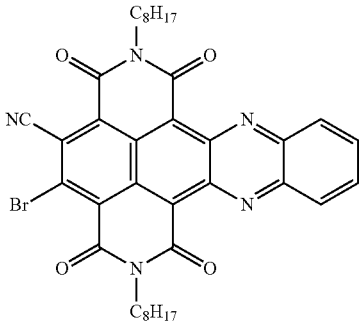

(1-3)

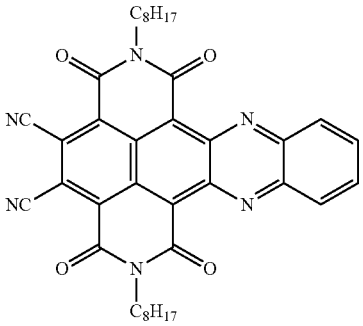

(1-4)

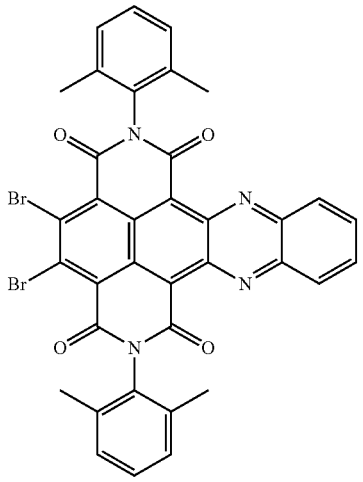

The electrophotographic photosensitive member 10 may contain only the naphthalenediimide derivative (1) as an electron transport material. Alternatively, the electrophotographic photosensitive member 10 may contain an additional electron transport material mentioned below in combination with the naphthalenediimide derivative (1).

Examples of the additional electron transport material that may be contained in combination with the naphthalenediimide derivative (1) include naphthoquinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride.

[Charge Generating Material]

The charge generating material is not particularly limited as long as it can function as a charge generating material in the photosensitive layer 12. Examples of the charge generating material include powders of organic photoconductive materials (e.g., X-form metal-free phthalocyanine (x-$H_2$Pc), Y-form titanyl phthalocyanine (Y-TiOPc), perylene pigments, bis-azo pigments, dithioketopyrrolopyrrole pigments, metal-free naphthalocyanine pigments, metal naphthalocyanine pigments, squaraine pigments, tris-azo pigments, indigo pigments, azulenium pigments, cyanine pigments, pyrylium salts, anthanthrone-based pigments, triphenylmethane-based pigments, threne-based pigments, toluidine-based pigments, pyrazoline-based pigments, or quinacridone-based pigments); and powders of inorganic photoconductive materials (e.g., selenium, selenium-tellurium, selenium-arsenic, cadmium sulfide, or amorphous silicon). The charge generating material is selected as appropriate so as to give an absorption wavelength in a desired range. These charge generating materials may be used independently, or two or more of the charge generating materials may be used in combination.

In particular, a photosensitive member having sensitivity in a wavelength range of 700 nm or longer is preferable in image forming apparatuses employing a digital optical system (e.g., laser beam printers including a semiconductor laser or the like as a light source and facsimile machines). Of the above-mentioned charge generating materials, therefore, phthalocyanine-based pigments (metal-free phthalocyanine such as X-form metal-free phthalocyanine or Y-form titanyl phthalocyanine) are preferably used, for example, for such image forming apparatuses. The crystal form of the phthalocyanine-based pigments is not particularly limited, and α- or β-phthalocyanine-based pigments may be used, for example.

When the image forming apparatus includes a short-wavelength laser light source emitting light having a wavelength of 350 nm or longer and 550 nm or shorter, an anthanthrone-based pigment or a perylene-based pigment is preferably used as the charge generating material, for example.

[Hole Transport Material]

The hole transport material is not particularly limited as long as it can function as a hole transport material in the photosensitive layer 12. Examples of the hole transport material include nitrogen containing cyclic compounds and condensed polycyclic compounds. Examples of the nitrogen containing cyclic compounds and the condensed polycyclic compounds include triphenyl amine-based compounds (e.g., N,N,N',N'-tetraphenylbenzidine derivatives, N,N,N',N'-tetraphenylphenylenediamine derivatives, N,N,N',N'-tetraphenylnaphtylenediamine derivatives, and N,N,N',N'-tetraphenylphenanthrylenediamine derivatives); oxadiazole-based compounds (e.g., 2,5-di (4-methylaminophenyl)-1,3,4-oxadiazole); styryl-based compounds (e.g., 9-(4-diethylaminostyryl)anthracene); carbazole-based compounds (e.g., polyvinyl carbazole); organopolysilane compounds; pyrazoline-based compounds (e.g., 1-phenyl-3-(p-dimethylaminophenyl)pyrazoline); hydrazone-based compounds; indole-based compounds; oxazole-based compounds; isoxazole-based compounds; thiazole-based compounds; thiadiazole-based compounds; imidazole-based compounds; pyrazole-based compounds; and triazole-based compounds. Specific examples of the N,N,N',N'-tetraphenylbenzidine derivatives include a derivative represented by the following formula (H-1).

(H-1)

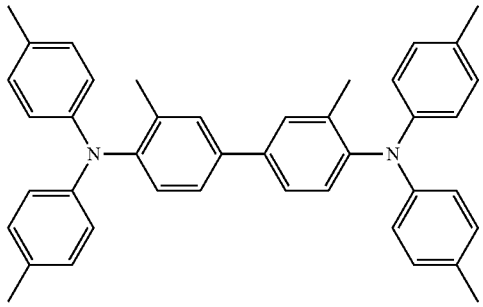

The compounds mentioned as the hole transport material may be used independently, or two or more of the compounds may be used in combination.

[Binder Resin]

The binder resin is used for dispersing therein the above-described components. The binder resin is not particularly limited as long as it can function as a binder resin in the photosensitive layer 12, and various resins are usable. Examples of the usable binder resins include thermoplastic resins (specifically, styrene-butadiene copolymers, styrene-acrylonitrile copolymers, styrene-maleic acid copolymers, acrylic copolymers, styrene-acrylic acid copolymers, polyethylene, ethylene-vinyl acetate copolymers, chlorinated polyethylene, polyvinyl chloride, polypropylene, ionomer, vinyl chloride-vinyl acetate copolymers, alkyd resins, polyamide resins, polyurethane resins, polycarbonate resins, polyarylate resins, polysulfone resins, diallyl phthalate resins, ketone resins, polyvinyl butyral resins, polyether resins, or polyester resins); cross-linkable thermosetting resins (specifically, silicone resins, epoxy resins, phenolic resins, urea resins, or melamine resins); and photocurable resins (specifically, epoxy acrylate or urethane acrylate).

When the electrophotographic photosensitive member of the present embodiment is a multi-layer photosensitive member, the charge generating layer of the multi-layer photosensitive member contains a base resin (binder resin for charge generating layer). The base resin is not particularly limited as long as it is a resin for charge generating layers of multi-layer photosensitive members. Examples of the base resin include the resins mentioned above as examples of the binder resin. Typically, a charge generating layer and a charge transport layer are formed in a multi-layer photosensitive member. Preferably, therefore, a resin different from the binder resin contained in the charge transport layer is used as the base resin in order to prevent the base resin from being dissolved in the solvent of a liquid applied for forming the charge transport layer.

[Additive]

The electrophotographic photosensitive member 10 of the present embodiment may contain, as needed, various known additives within a range not impairing the effect of the present disclosure. Examples of the additives include antidegradants, softeners, plasticizers, surface modifiers, extenders, thickeners, dispersion stabilizers, waxes, acceptors, and donors. Examples of the antidegradants include antioxidants, radical scavengers, singlet quenchers, and ultraviolet absorbing agents. In order to enhance the photosensitivity of the photosensitive layer 12, a known sensitizer (e.g., terphenyl, halonaphthoquinones, or acenaphthylene) may be used in combination with the charge generating material.

The contents of the naphthalenediimide derivative (1), the charge generating material, the hole transport material, and the binder resin in the electrophotographic photosensitive member 10 of the present embodiment are not particularly limited and can be determined as appropriate. Specifically, the content of the naphthalenediimide derivative (1) is preferably 5 parts by mass or more and 100 or less, and more preferably 10 parts by mass or more and 80 parts by mass or less relative to 100 parts by mass of the binder resin. When the content of the naphthalenediimide derivative (1) is 5 parts by mass or more, desired photosensitivity is sufficiently produced. When the content of the naphthalenediimide derivative (1) is 100 parts by mass or less, the photosensitivity does not become saturated, providing a cost advantage.

The content of the charge generating material is preferably 0.1 parts by mass or more and 50 parts by mass or less, and more preferably 0.5 parts by mass or more and 30 parts by mass or less relative to 100 parts by mass of the binder resin. When the content of the charge generating material is 0.1 parts by mass or more, desired photosensitivity is sufficiently produced. When the content of the charge generating material is 50 parts by mass or less, the photosensitivity does not become saturated, providing a cost advantage.

The content of the hole transport material is preferably 5 parts by mass or more and 500 parts by mass or less, and more preferably 25 parts by mass or more and 200 parts by mass or less relative to 100 parts by mass of the binder resin. When the content of the hole transport material is 5 parts by mass or more, desired photosensitivity is sufficiently produced. When the content of the hole transport material is 500 parts by mass or less, the photosensitivity does not become saturated, providing a cost advantage.

The thickness of the photosensitive layer 12 is not particularly limited as long as the photosensitive layer 12 can produce a sufficient effect. The photosensitive layer 12 preferably has a thickness of 5 μm or more and 100 μm or less, and more preferably 10 μm or more and 50 μm or less, for example.

Next, an example of the method for producing the electrophotographic photosensitive member 10 will be described. First, the naphthalenediimide derivative (1), a charge generating material, a hole transport material, a binder resin, and one or more optional additives are dissolved or dispersed in a solvent to give an application liquid. The application liquid is applied to the conductive substrate 11 by an appropriate application method. Next, the liquid applied is dried. Thus, the electrophotographic photosensitive member 10 is produced. The application method is not particularly limited, and examples thereof include dip coating.

The solvent to be used in the application liquid is not particularly limited as long as the components to be contained in the application liquid can be dissolved or dispersed therein. Examples of the solvent include alcohols (specifically, methanol, ethanol, isopropanol, or butanol), aliphatic hydrocarbons (specifically, n-hexane, octane, or cyclohexane), aromatic hydrocarbons (specifically, benzene, toluene, or xylene), halogenated hydrocarbons (specifically, dichloromethane, dichloroethane, carbon tetrachloride, or chlorobenzene), ethers (specifically, dimethyl ether, diethyl ether, tetrahydrofuran, ethylene glycol dimethyl ether, or diethylene glycol dimethyl ether), ketones (specifically, acetone, methyl ethyl ketone, or cyclohexane), esters (specifically, ethyl acetate, or methyl acetate), dimethyl formaldehyde, dimethyl formamide, and dimethyl sulfoxide. These solvents may be used independently, or two or more of the solvents may be used in combination.

The electrophotographic photosensitive member 10 as described above is used as an image bearing member in an electrographic image forming apparatus, for example. Including the electrophotographic photosensitive member 10 as an image bearing member, the image forming apparatus can form high-quality images. Furthermore, damages that may be caused to the photosensitive layer 12 of the electrophotographic photosensitive member 10 can be reduced.

EXAMPLES

Hereinafter, the present disclosure will be described in more detail by way of examples. The present disclosure is in no way limited to the examples.

Synthesis of Naphthalenediimide Derivative

Synthesis Example 1

The naphthalenediimide derivative (1-1) (molecular weight: 750.5) was synthesized in accordance with the following scheme (r-1).

(1-1)

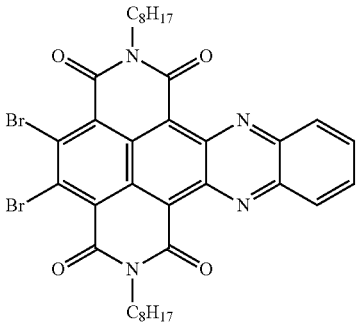

(r-1)

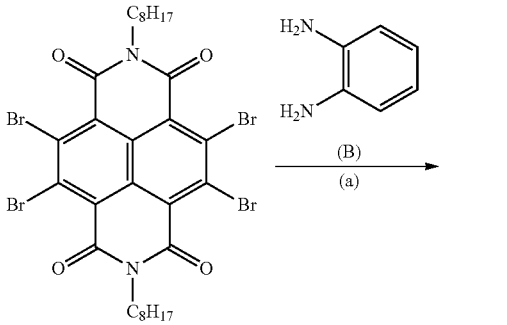

(A-1)

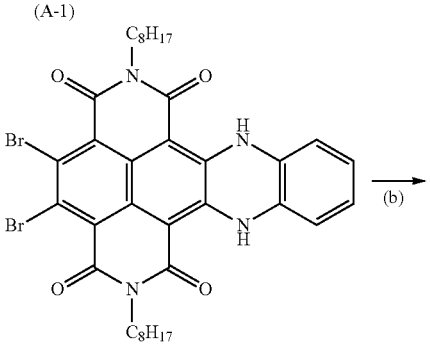

(C-1)

-continued

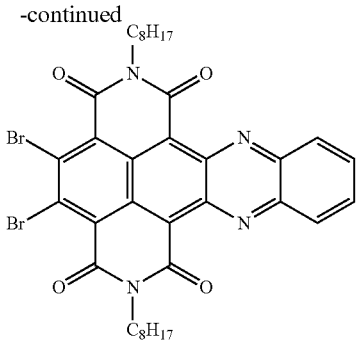

(1-1)

In (a) in the scheme (r-1), o-phenylenediamine (B) (molecular weight: 108.1, 1.4 g, 12.4 mmol) and chloroform as a solvent were added to a compound (A-1) (molecular weight: 806.2, 1 g, 1.24 mmol). The resulting chloroform solution was stirred at room temperature for 10 hours to give a reaction solution. The chloroform as a solvent in the reaction solution was removed by evaporation. A reaction product thus obtained was purified by column chromatography to give a compound (C-1) (molecular weight: 752.5, 0.75 g, yield: 80%).

In (b) in the scheme (r-1), lead oxide (10 g, 40 mmol) and chloroform as a solvent were added to the compound (C-1) (0.5 g, 0.66 mmol). The resulting chloroform solution was stirred at room temperature for 15 minutes to give a reaction solution. Thereafter, the reaction solution was filtered, and the chloroform as a solvent in the filtrate was removed by evaporation. A reaction product thus obtained was purified by column chromatography to give the naphthalenediimide derivative (1-1) (0.4 g, yield: 80%). The naphthalenediimide derivative (1-1) thus obtained was measured using a 500 MHz proton nuclear magnetic resonance ($^1$H-NMR) spectrometer. $CDCl_3$ was used as a solvent. The $^1$H-NMR spectral data of the naphthalenediimide derivative (1-1) is as follows. $^1$H-NMR ($CDCl_3$, 500 MHz): δ=8.38-8.35 (m, 2H), 8.01-7.99 (m, 2H), 4.36-4.33 (t, J=8.2 Hz, 4H), 1.90-1.87 (m, 4H), 1.52-1.49 (m, 4H), 1.44-1.40 (m, 4H), 1.35-1.28 (m, 12H), 0.90-0.87 (t, J=6.95 Hz, 6H)

Synthesis Example 2

The following naphthalenediimide derivative (1-2) (molecular weight: 696.6) and the following naphthalenediimide derivative (1-3) (molecular weight: 642.7) were synthesized as follows. First, a compound (D-1) (molecular weight: 698.6) and a compound (D-2) (molecular weight: 644.8) were synthesized from the naphthalenediimide derivative (1-1) in accordance with the scheme (r-1a). Thereafter, the naphthalenediimide derivatives (1-2) and (1-3) were synthesized from the compounds (D-1) and (D-2), respectively.

(1-2)

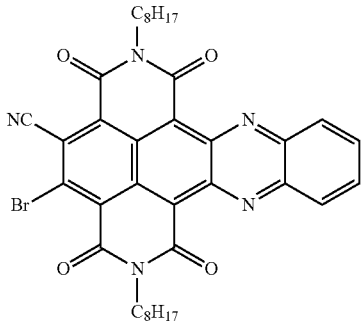

-continued (1-3)

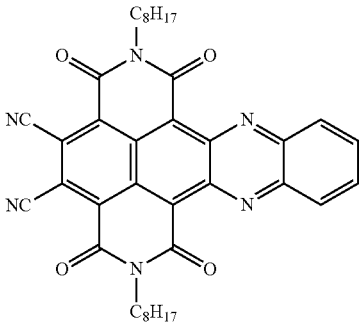

(r-1a)

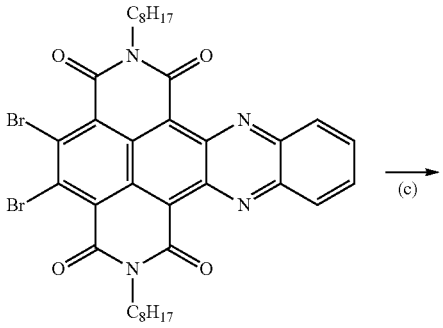

(1-1)

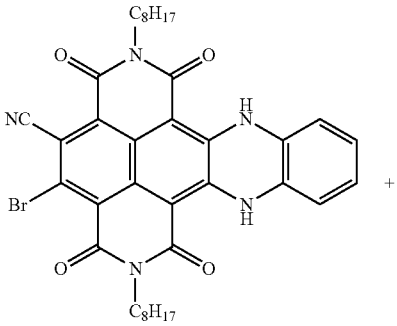

(D-1)

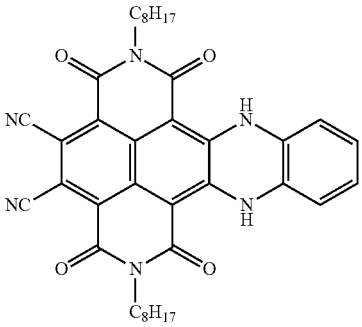

(D-2)

In (c) in the scheme (r-1a), bis(dibenzylideneacetone)dipalladium ($Pd_2(dba)_2$) (120 mg, 0.13 mmol), copper cyanide (CuCN) (8 g, 80 mmol), and dioxane as a solvent were added to the naphthalenediimide derivative (1-1) (1 g, 1.3 mmol). A dioxane solution thus obtained was stirred under an inert gas at 50° C. for 10 hours. Thereafter, the dioxane solution was cooled to room temperature, and then filtered. A reaction product thus obtained was purified by column chromatography to give the compound (D-1) (0.28 g, yield: 30%) and the compound (D-2) (0.2 g, yield: 24%).

Thereafter, lead oxide (4 g, 17 mmol) and chloroform as a solvent were added to the compound (D-1) (0.2 g, 0.29 mmol). A chloroform solution thus obtained was stirred at room temperature for 15 minutes to give a reaction solution. Thereafter, the reaction solution was filtered, and the chloroform as a solvent in the filtrate was removed by evaporation. A reaction product thus obtained was purified by column chromatography to give the naphthalenediimide derivative (1-2) (0.19 g, yield: 95%).

Likewise, lead oxide (4.5 g, 18.6 mmol) and chloroform as a solvent were added to the compound (D-2) (0.2 g, 0.31 mmol). A chloroform solution thus obtained was stirred at room temperature for 15 minutes to give a reaction solution. Thereafter, the reaction solution was filtered, and the chloroform as a solvent in the filtrate was removed by evaporation. A reaction product thus obtained was purified by column chromatography to give the naphthalenediimide derivative (1-3) (0.19 g, yield: 95%).

Synthesis Example 3

The naphthalenediimide derivative (1-4) (molecular weight: 734.4) was synthesized in accordance with the following scheme (r-2).

(1-4)

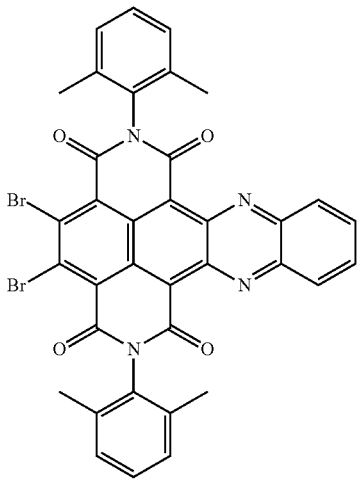

(r-2)

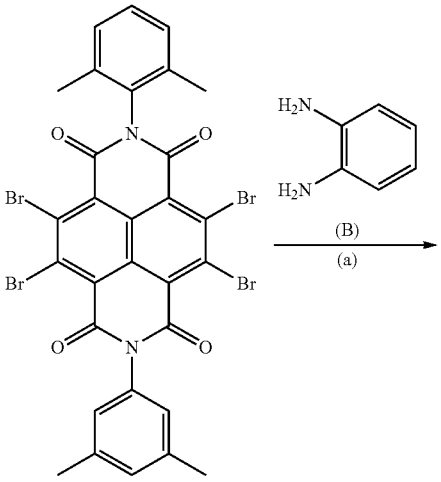

(A-2)

-continued

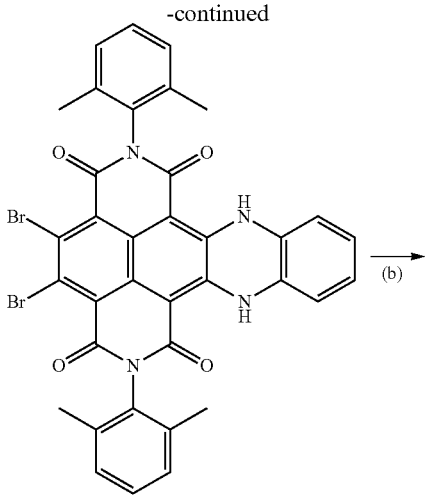

(C-2)

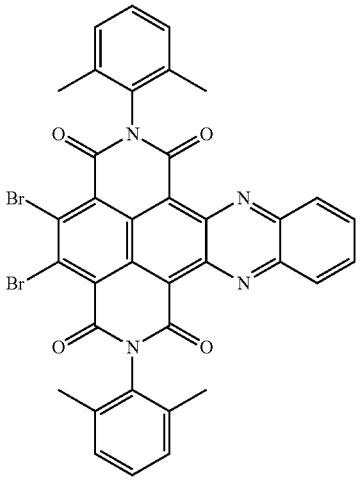

(1-4)

In (a) in the scheme (r-2), o-phenylenediamine (B) (1.4 g, 12.4 mmol) and chloroform as a solvent were added to a compound (A-2) (molecular weight: 790.1, 1 g, 1.26 mmol). A chloroform solution thus obtained was stirred at room temperature for 10 hours to give a reaction solution. Thereafter, the chloroform as a solvent in the reaction solution was removed by evaporation. A reaction product thus obtained was purified by column chromatography to give a compound (C-2) (molecular weight: 736.4, 0.75 g, yield: 80%).

In (b) in the scheme (r-2), lead oxide (10 g, 40 mmol) and chloroform as a solvent were added to the compound (C-2) (0.5 g). A chloroform solution thus obtained was stirred at room temperature for 15 minutes to give a reaction solution. Thereafter, the reaction solution was filtered, and the chloroform as a solvent in the filtrate was removed by evaporation. A reaction product thus obtained was purified by column chromatography to give the naphthalenediimide derivative (1-4) (0.37 g, yield: 75%).

Example 1

1. Production of Electrophotographic Photosensitive Member

First, 5 parts by mass of crystal form X of a metal-free phthalocyanine represented by the following formula ($x\text{-}H_2Pc$) (hereinafter, may be referred to as "X-form metal-free phthalocyanine ($x\text{-}H_2Pc$)" as a charge generating material, 50 parts by mass of a hole transport material represented by the following formula (H-1), 50 parts by mass of the naphthalenediimide derivative (1-1) as an electron transport material synthesized in Synthesis Example 1, 100 parts by mass of a polycarbonate resin, and 800 parts by mass of a solvent (tetrahydrofuran) were put in a vessel. Next, the content of the vessel was mixed for 50 hours using a ball mill, and the substances were dispersed in the solvent to give an application liquid for photosensitive layer formation.

Then, an aluminum substrate (support substrate) with one end up was dipped in the application liquid for photosensitive layer formation at an application rate of 5 mm/second and thus coated with the application liquid. Thereafter, the substrate was hot-air dried at 100° C. for 60 minutes to cure the application liquid. Thus, an electrophotographic photosensitive member of Example 1 was obtained. The photosensitive layer of the electrophotographic photosensitive member of Example 1 had a thickness of 30 μm.

($x\text{-}H_2Pc$)

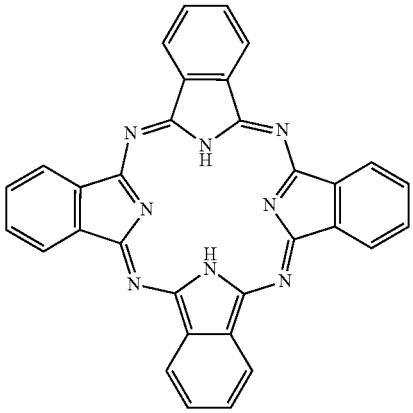

(H-1)

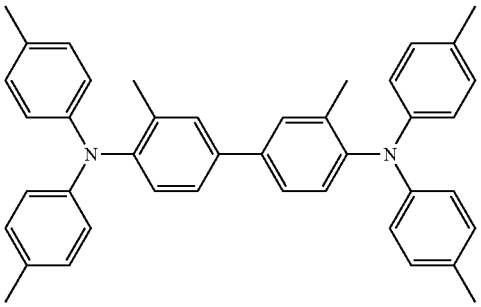

Example 2

An electrophotographic photosensitive member of Example 2 was obtained in the same manner as in Example 1 except that instead of the X-form metal-free phthalocyanine ($x\text{-}H_2Pc$), the same amount of a Y-form titanyl phthalocyanine represented by the following formula (Y-TiOPc) (hereinafter, may be referred to as "Y-form titanyl phthalocyanine (Y-TiOPc)") was used as a charge generating material.

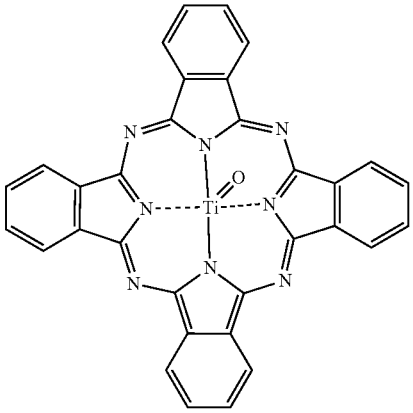

(Y-TiOPc)

Example 3

An electrophotographic photosensitive member of Example 3 was obtained in the same manner as in Example 1 except that instead of the naphthalenediimide derivative (1-1), the same amount of the naphthalenediimide derivative (1-2) obtained in Synthesis Example 2 was used as an electron transport material.

Example 4

An electrophotographic photosensitive member of Example 4 was obtained in the same manner as in Example 1 except that instead of the X-form metal-free phthalocyanine (x-$H_2$Pc), the same amount of the Y-form titanyl phthalocyanine (Y-TiOPc) was used as a charge generating material, and instead of the naphthalenediimide derivative (1-1), the same amount of the naphthalenediimide derivative (1-2) synthesized in Synthesis Example 2 was used as an electron transport material.

Example 5

An electrophotographic photosensitive member of Example 5 was obtained in the same manner as in Example 1 except that instead of the naphthalenediimide derivative (1-1), the same amount of the naphthalenediimide derivative (1-3) obtained in Synthesis Example 3 was used as an electron transport material.

Example 6

An electrophotographic photosensitive member of Example 6 was obtained in the same manner as in Example 1 except that instead of the X-form metal-free phthalocyanine (x-$H_2$Pc), the same amount of the Y-form titanyl phthalocyanine (Y-TiOPc) was used as a charge generating material, and instead of the naphthalenediimide derivative (1-1), the same amount of the naphthalenediimide derivative (1-3) synthesized in Synthesis Example 3 was used as an electron transport material.

Example 7

An electrophotographic photosensitive member of Example 7 was obtained in the same manner as in Example 1 except that instead of the naphthalenediimide derivative (1-1), the same amount of the naphthalenediimide derivative (1-4) synthesized in Synthesis Example 4 was used as an electron transport material.

Example 8

An electrophotographic photosensitive member of Example 8 was obtained in the same manner as in Example 1 except that instead of the X-form metal-free phthalocyanine (x-$H_2$Pc), the same amount of the Y-form titanyl phthalocyanine (Y-TiOPc) was used as a charge generating material, and instead of the naphthalenediimide derivative (1-1), the same amount of the naphthalenediimide derivative (1-4) synthesized in Synthesis Example 4 was used as an electron transport material.

Comparative Example 1

An electrophotographic photosensitive member of Comparative Example 1 was obtained in the same manner as in Example 1 except that instead of the naphthalenediimide derivative (1-1), the same amount of a naphthalenediimide derivative represented by the following formula (E-1) was used as an electron transport material.

(E-1)

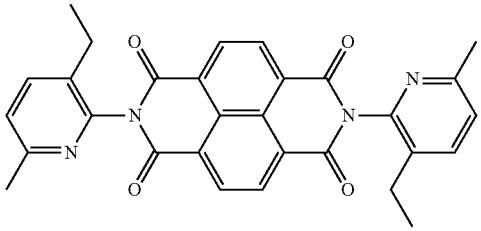

Comparative Example 2

An electrophotographic photosensitive member of Comparative Example 2 was obtained in the same manner as in Example 1 except that instead of the X-form metal-free phthalocyanine (x-$H_2$Pc), the same amount of the Y-form titanyl phthalocyanine (Y-TiOPc) was used as a charge generating material, and instead of the naphthalenediimide derivative (1-1), the same amount of the naphthalenediimide derivative represented by the formula (E-1) was used as an electron transport material.

2. Evaluation of Electrophotographic Photosensitive Members

<Evaluation of Photosensitivity>

The photosensitivity of the electrophotographic photosensitive members obtained in the examples and the comparative examples was evaluated. Each of the electrophotographic photosensitive members was charged to 700 V using a drum sensitivity test device (manufactured by Gentec Inc.) Next, monochromatic light having a wavelength of 780 nm (half-width: 20 nm, light amount: 16 $\mu W/cm^2$) was extracted from light emitted from a halogen lamp through a bandpass filter. The electrophotographic photosensitive member was irradiated with the monochromatic light having a wavelength of 780 nm (irradiation time: 80 milliseconds). The surface potential (residual potential) was measured after a lapse of 330 milliseconds from the start of the irradiation. The results of the evaluation of the photosensitivity are shown in Table 1. The photosensitive layer of each electrophotographic photosensitive member had a film thickness of 30 μm.

<Evaluation of Crystallization>

The occurrence of crystallization on the surface of the electrophotographic photosensitive member obtained in each of the examples and the comparative examples was observed. Specifically, the presence or absence of crystals on the surface of each electrophotographic photosensitive member was observed using an optical microscope. Based on the observation results, the crystallization of the photosensitive members were evaluated in accordance with the following criteria. The evaluation results are shown in Table 1.

NO: No crystals were observed.

YES: Some crystals were observed.

Table 1 shows the results of the evaluations on the electrophotographic photosensitive members obtained in the examples and the comparative examples.

TABLE 1

| | CGM | HTM | ETM-1 | Photosensitivity (V) | External observation of drum (occurrence of crystallization) |
|---|---|---|---|---|---|
| Example 1 | x-$H_2$Pc | H-1 | 1-1 | 108 | NO |
| Example 2 | Y-TiOPc | H-1 | 1-1 | 103 | NO |
| Example 3 | x-$H_2$Pc | H-1 | 1-2 | 105 | NO |
| Example 4 | Y-TiOPc | H-1 | 1-2 | 100 | NO |
| Example 5 | x-$H_2$Pc | H-1 | 1-3 | 100 | NO |
| Example 6 | Y-TiOPc | H-1 | 1-3 | 96 | NO |
| Example 7 | x-$H_2$Pc | H-1 | 1-4 | 102 | NO |
| Example 8 | Y-TiOPc | H-1 | 1-4 | 99 | NO |
| Comparative Example 1 | x-$H_2$Pc | H-1 | E-1 | 135 | YES |
| Comparative Example 2 | Y-TiOPc | H-1 | E-1 | 130 | YES |

As obvious from Table 1, the electrophotographic photosensitive members of Examples 1 to 8 showed excellent photosensitivity since they each contained the specified naphthalenediimide derivative, and the naphthalenediimide derivative was homogeneously dispersed in the photosensitive layer, preventing the crystallization. In addition, no crystallization was observed in the drums of the electrophotographic photosensitive members of Examples 1 to 8.

On the contrary, the electrophotographic photosensitive members obtained in Comparative Examples 1 and 2 showed poor photosensitivity since they did not contain the specified naphthalenediimide derivative, and therefore the crystallization in the photosensitive layer was not prevented. In addition, some crystallization was observed in the drums of the electrophotographic photosensitive members of Comparative Examples 1 and 2.

What is claimed is:

1. An electrophotographic photosensitive member comprising a conductive substrate and a photosensitive layer provided on the conductive substrate, wherein the photosensitive layer contains a charge generating material and an electron transport material, and the electron transport material contains a naphthalenediimide derivative represented by the general formula (1)

(1)

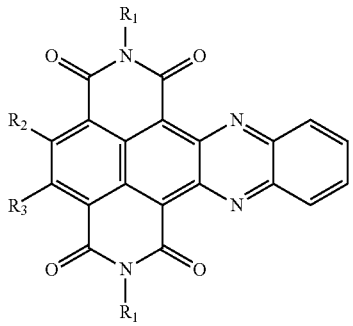

wherein $R_1$ represents an alkyl group having 1 to 10 carbon atoms, an aryl group having 6 to 12 carbon atoms and optionally having an alkyl group having 1 to 10 carbon atoms, an aralkyl group having 7 to 12 carbon atoms, a cycloalkyl group having 3 to 10 carbon atoms, or an alkoxy group having 1 to 6 carbon atoms, and $R_2$ and $R_3$, independently from each other, each represent an alkyl group having 1 to 4 carbon atoms, a halogen group, or a cyano group.

2. An electrophotographic photosensitive member according to claim 1, wherein the photosensitive layer further contains a hole transport material and a binder resin, and the photosensitive layer contains the charge generating material, the hole transport material, the electron transport material, and the binder resin in a single layer.

3. An electrophotographic photosensitive member according to claim 1, wherein $R_2$ is a halogen group or a cyano group, and $R_3$ is a halogen group or a cyano group in the general formula (1).

4. An electrophotographic photosensitive member according to claim 1, wherein $R_2$ and $R_3$ are the same functional group in the general formula (1).

5. An electrophotographic photosensitive member according to claim 1, wherein $R_1$ is an octyl group in the general formula (1).

6. An electrophotographic photosensitive member according to claim 1, wherein $R_1$ is a xylyl group in the general formula (1).

* * * * *